US005809902A

United States Patent [19]

Zetterberg

[11] Patent Number: 5,809,902

[45] Date of Patent: Sep. 22, 1998

[54] PALLET

[76] Inventor: Mats Zetterberg, Lövlundsvagen 89A, S-814 91 Furuvik, Sweden

[21] Appl. No.: 716,297

[22] PCT Filed: Mar. 27, 1995

[86] PCT No.: PCT/SE95/00325

§ 371 Date: Sep. 24, 1996

§ 102(e) Date: Sep. 24, 1996

[87] PCT Pub. No.: WO95/26305

PCT Pub. Date: Oct. 5, 1995

[30] Foreign Application Priority Data

Mar. 25, 1994 [SE] Sweden ..... 9401017

[51] Int. Cl.[6] ..... B65D 19/00

[52] U.S. Cl. ..... 108/51.1; 108/56.3; 108/56.1; 411/466

[58] Field of Search ..... 108/51.1, 56.1, 108/56.3, 27; 312/140; 411/466, 467, 468

[56] References Cited

U.S. PATENT DOCUMENTS

| | | | |
|---|---|---|---|
| 1,095,119 | 4/1914 | Krum | 411/466 |
| 2,282,859 | 5/1942 | Frey | 411/466 X |
| 2,371,106 | 3/1945 | Lewis et al. . | |
| 2,651,486 | 9/1953 | Woodward . | |
| 2,817,485 | 12/1957 | White et al. . | |
| 2,923,511 | 2/1960 | Garbarino . | |
| 2,933,339 | 4/1960 | Alvden | 108/51.1 X |
| 3,243,245 | 3/1966 | Kewley | 312/140 X |
| 3,678,868 | 7/1972 | Hirota | 108/51.1 |
| 3,836,217 | 9/1974 | Shiina | 312/140 X |
| 3,999,236 | 12/1976 | Macauley | 248/188 X |
| 4,220,099 | 9/1980 | Marchesano | 108/51.1 |
| 4,272,938 | 6/1981 | Seipos | 411/467 X |
| 5,417,167 | 5/1995 | Sadr | 108/51.1 |

FOREIGN PATENT DOCUMENTS

| | | | |
|---|---|---|---|
| 1301889 | 7/1962 | France | 108/56.1 |
| 403256846 | 11/1991 | Japan | 108/56.1 |

*Primary Examiner*—Peter M. Cuomo
*Assistant Examiner*—Hahn V. Tran
*Attorney, Agent, or Firm*—Ostrolenk Faber, Gerb & Soffen, LLP

[57] ABSTRACT

A pallet includes a pair of rails with inner side surfaces that have mortises formed therein near their top surface and are arranged facing each other. Load deck boards extend between the rails and have ends that substantially correspond to the mortises. The boards are inserted into the mortises to form a mortise joint. Fixing members formed of integral legs conform to the outer surfaces of the rails. A flange extends from each leg along its length and in a direction such that one of the flanges can be inserted into a longitudinal groove formed in an outer side surface of a rail and another flange can be inserted into another corresponding groove that is formed in the top surface of the rail and in the boards, thus securing the boards to the rails. The flanges of the fixing member are removable from the grooves, and the boards are removable from the mortises to permit disassembly of the pallet.

8 Claims, 2 Drawing Sheets

PALLET

BACKGROUND OF THE INVENTION

The present invention relates to an arrangement for load pallets, and includes at least two spaced rails carrying a load deck, it being also possible to provide the rails with bottom boards or runners for bearing against a substructure.

The pallets normally available on the market today have a given life span, during which they are repaired several times, in order to avoid scrapping them too soon. Such repairs have been found to be very time-consuming and expensive, thus making it cheaper in many cases to procure a new pallet instead of repairing an old one.

SUMMARY OF THE INVENTION

The object of the present invention is to achieve a load pallet that is easy to repair when it becomes unserviceable, the purchaser himself even being able to make the repair on his own premises without the need of special tools. The features distinguishing the invention are disclosed in the accompanying claims.

Due to the invention there has now been provided a pallet of the kind mentioned in the introduction, in which the drawbacks pertaining to the pallets already on the market have been eliminated. The inventive pallet is put together using fixing members and few parts that may be assembled without the use of special tools, and with the aid of fixing members. The fixing members are accommodated in grooves situated longitudinally at the end regions of the pallets, and fix the load-carrying deck boards to the rails at right angles to, and at each end of the boards. The fixing member may be made from metal, and is positionally fixed to the deck boards by impressing a corner edge or other outer portion of the member into the pallet material, or by hammering in a nail or the like, from above (for example) through the outer portions of the member for fixing it to the pallet. Since no other fasteners are required for keeping the pallet together it can be very easily disassembled, should it become damaged, by freeing the fixing member. The deck boards are morticed into the carrying rails, and this ensures an increased life span for the pallet as well as enabling it to maintain squareness, even though it may be subjected to rough treatment. Pallet stability is further increased by the mortices being implemented such as to form dovetails. Accordingly, no unnecessary play is formed between rail and boards, while at the same time upward or sideways movement of the boards is inhibited by the dovetail configuration. Finally, the fixing members that coact with the grooves in both rails and boards for keeping the pallet together also contribute in making the structure stable.

DESCRIPTION OF THE DRAWINGS

The invention will now be described in more detail with the aid of a pair of embodiment examples, and with reference to the accompanying drawings, where.

DETAILED DESCRIPTION OF THE INVENTION

Figure 1:
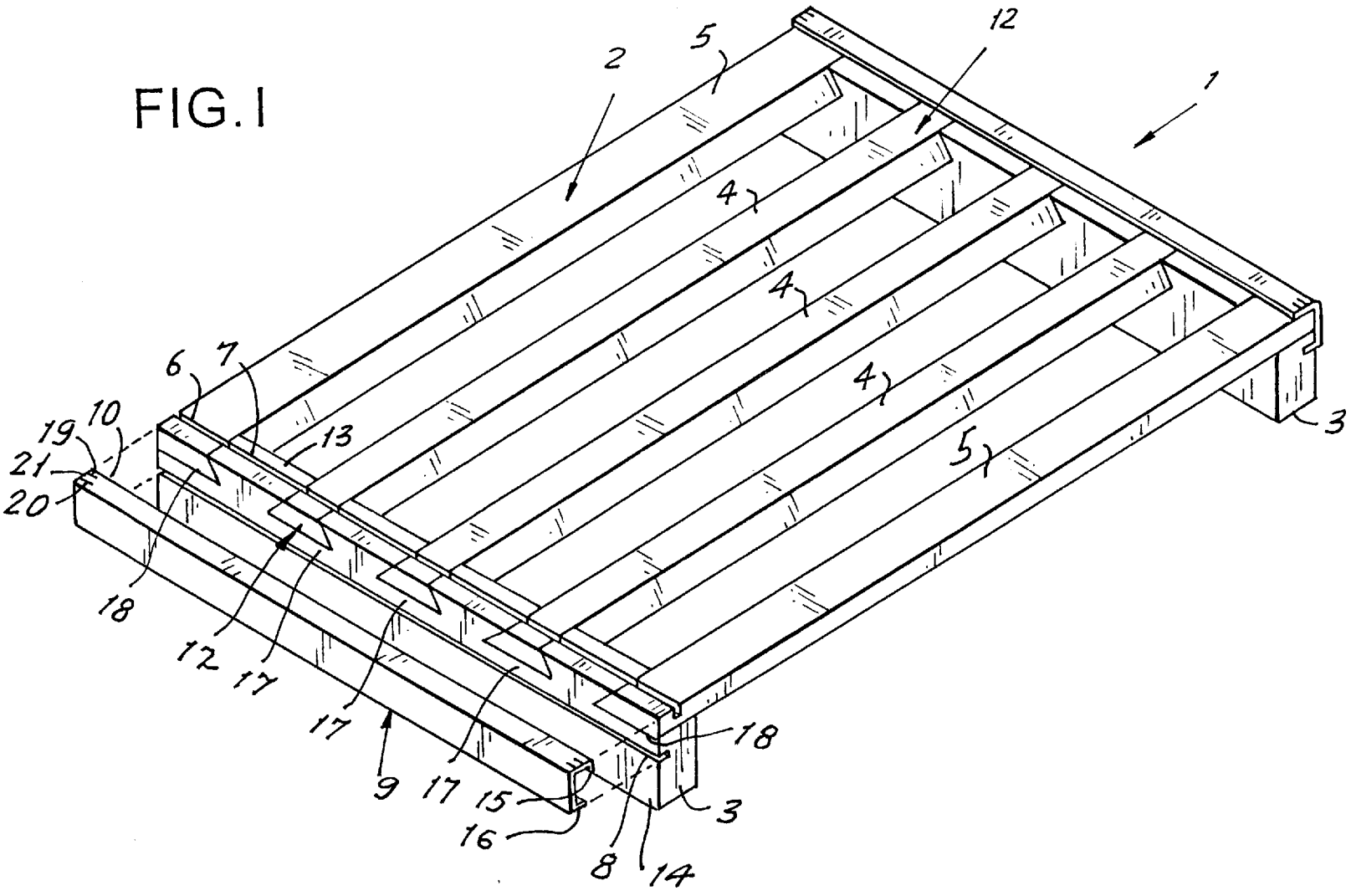
FIG. 1 illustrates a schematic, perspective view of a first embodiment of a pallet in accordance with the invention, where one of the fixing members is shown as fitted, the other one being shown spaced from the pallets.
Figure 2:
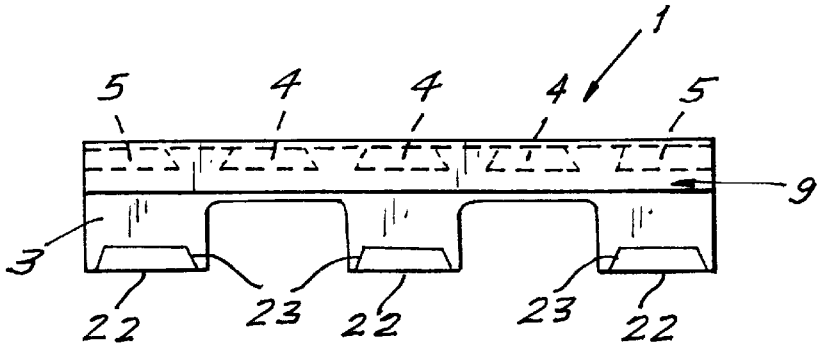
FIG. 2 is a side elevation of the inventive pallet in an alternative embodiment, where the carrying rails are provided with bottom boards or runners for bearing against a substructure.
Figure 3:
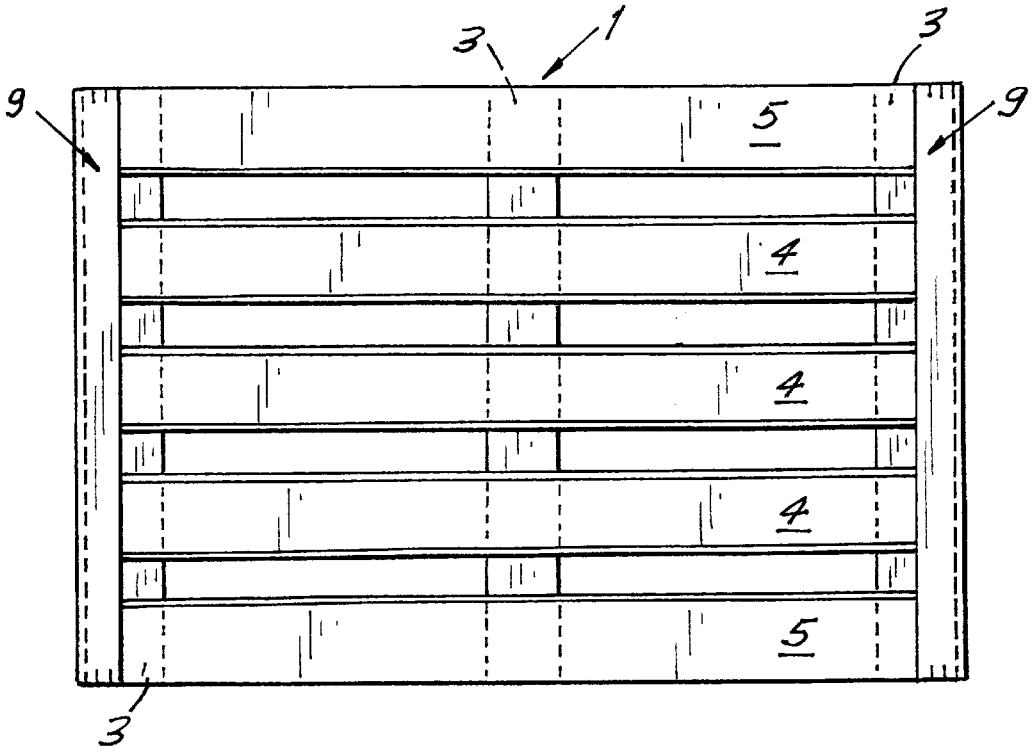
FIG. 3 is a view from above of the pallet illustrated in FIG. 2.
Figure 4:
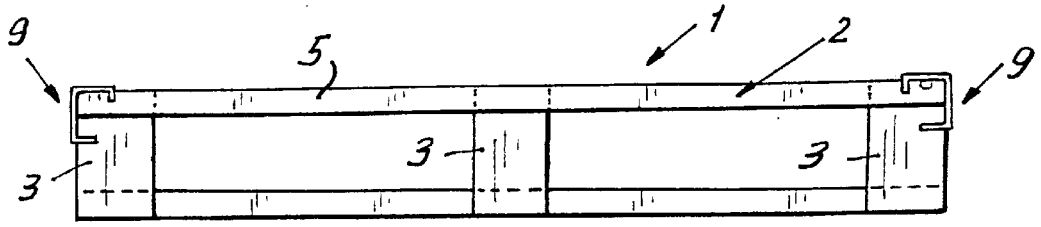
FIG. 4 is a side elevation of the pallet illustrated in FIGS. 2 and 3.

As will be understood more clearly from the embodiment of the pallet 1 in accordance with the invention, and illustrated in FIG. 1, the pallet comprises a load deck 2 carried by rails 3, provided in appropriate cases (as illustrated in FIGS. 2–4) with bottom boards or runners 22. The rails 3 also serve as spacers for the deck 2. The latter comprises a plurality of boards 4, 5, which may be made from plastics, sheet metal, wood or any other suitable material, and this also applies to the rails 3, of course. The deck boards 4, 5 are morticed, and removably fitted, into the rails 3, such that when they are fitted they are positionally fixed with the aid of at least two elongate, angularly folded fixing members 9, which are insertable in grooves 6–8 made in the boards 4, 5 transverse their longitudinal direction.

In the illustrated example, the pallet 1 includes two fixing members 9. Each member 9 is formed with two legs 10 and 11, mutually, substantially at right angles, and which are respectively provided with an inwardly directed flange 15, 16 substantially parallel to the other leg. The flange 15 coacts with a groove 6, 7 extending continuously over the end portions 12 of the boards 4, 5 and the upper side 13 of the rail, while the other flange 16 coacts with a groove 8 made in the outer side 14 of the rail 3. The depth of the grooves 6, 7 is approximately ⅓ of the board thickness, but should not exceed half of this thickness. The width and depth of the flanges 15, 16 and grooves 6–8 are in mutual, substantial correspondence. With the aid of grooves 6–8 members 9 positionally fix the boards 4, 5 and rails 3 in mutual relationship without needing nails or other fastening means. The cross-sectional configuration of the boards 4, 5 morticed into the rails 3 in the illustrated embodiment substantially concurs with full dovetails 17 for boards 4 and half dovetails 18 for boards 5. Accordingly, boards 4 can only be inserted in their mortices 17, which have a shape that corresponds to the dovetails of the boards, in one direction, which is at right angles to the rails.

The ends of the members 9 may be provided with short slits 19, 20 to form tabs 21, which are intended for being pressed into the outer deck boards 5 to obtain positional fixation of members 9 and boards 5. If bottom boards or runners 22 bearing against a substructure are used, they may coact with mortices 23 in the rails 3 for increasing stability of the pallet 1.

In assembling the different parts forming the pallet 1 in accordance with the invention it is suitable to start by putting boards 4, 5 into their mortices 17, 18 in rails 3, subsequent to which flanges 15, 16 on fixing members 9 are urged into grooves 6–8, either from the front or side. The members 9 may then be fastened in place by pressing the material in them into the outer boards 5 with the aid of a centre punch or the like. Alternatively, the tabs 21 can be forced into the respective end portion of the boards 5. A further method of fastening the fixing members is to use a nail or the like, which passes through member 9, board 4 or 5 and into rail 3. When the pallet is to be disassembled, the nails are drawn out, or the tabs 21 lifted, after which members 9 can be removed, allowing boards 4, 5 to be released from rails 3.

The inventive pallet has the advantage that its different parts are readily separated, which is particularly favourable from the environmental aspect when it is since combustible parts and other parts, which may be injurious to the environment can be easily separated into different batches.

I claim:

1. A pallet comprising:

a pair of rails each having a top surface, an inner side surface and an outer side surface, said inner side surface of each of said rails having a plurality of mortises formed therein adjacent to said top surface, said inner side surface of one of said rails being arranged facing said inner side surface of another of said rails;

a plurality of load deck boards extending between said rails, each end of each of said boards having a cross-sectional shape substantially corresponding to a respective one of said mortises in one of said rails and being inserted into said respective mortise to form a mortise joint with said rail; and at least two fixing members each having a pair of integral legs that are arranged to substantially conform with said top surface and said outer side surface of one of said rails, each of said legs having a flange extending therefrom along a length of said leg and in a direction such that one of said flanges of a respective one of said fixing members is insertable into a corresponding groove formed along a longitudinal direction in said outer side surface of a respective one of said rails and another of said flanges of said respective fixing member is insertable into another corresponding groove formed in said top surface of said respective rail and in said top surface of said boards to secure said boards to said rails;

said flanges of said fixing member being removable from said grooves and said boards being removable from said respective mortises to disassemble said pallet.

2. The pallet of claim 1 wherein said legs of each one of said fixing members are arranged substantially at right angles to each other.

3. The pallet of claim 1 wherein each of said flanges has a depth and a width that substantially corresponds to a depth and a width of said corresponding groove.

4. The pallet of claim 1 wherein each of said mortises of said rails is wider at a lower portion than at an upper portion of said mortises, and said cross-sectional shape of each end of each of said boards is wider at a bottom surface than at said top surface.

5. The pallet of claim 4 wherein said plurality of boards includes a pair of outer boards and a plurality of inner boards arranged between said outer boards, said cross-sectional shape at each end of each of said outer boards and its corresponding respective mortise have half-dovetail shapes, and said cross-sectional shape at each end of each of said inner boards and its corresponding respective mortise have full-dovetail shapes.

6. The pallet of claim 1 wherein each of said boards is insertable into said rails only at a right angle to said rails.

7. The pallet of claim 1 wherein at least one end of each of said fixing members includes slits formed therein which forms a tab that is insertable into a respective one of said boards to fix said respective board to said fixing member.

8. The pallet of claim 1 further comprising a plurality of bottom boards extending between said rails, said inner side surface of each of said rails having a further plurality of mortises formed therein adjacent to said bottom surface, each end of each of said bottom boards having a cross-sectional shape substantially corresponding to a respective one of said further mortises in each of said rails and being removably inserted into said respective further mortise.

* * * * *